US005350347A

United States Patent [19]

Fujiwara et al.

[11] Patent Number: 5,350,347

[45] Date of Patent: Sep. 27, 1994

[54] TURRET PUNCH PRESS

[75] Inventors: Takayuki Fujiwara, Kanagawa, Japan; Konrad Popp, Augsburg, Fed. Rep. of Germany

[73] Assignee: Amada Company, Limited, Kanagawa, Japan

[21] Appl. No.: 928,314

[22] Filed: Aug. 12, 1992

[30] Foreign Application Priority Data

Sep. 5, 1991 [DE] Fed. Rep. of Germany ..... 4129556

[51] Int. Cl.[5] ..... B23Q 3/155; B21D 37/04

[52] U.S. Cl. ..... 483/29; 83/552; 83/563; 483/28

[58] Field of Search ..... 483/1, 14, 15, 28, 29; 72/442; 83/563, 559, 552

[56] References Cited

U.S. PATENT DOCUMENTS

| | | | |
|---|---|---|---|
| 3,449,991 | 6/1969 | Daniels | 83/215 X |
| 3,548,480 | 12/1970 | Daniels | 483/28 X |
| 3,685,380 | 8/1972 | Daniels | 83/552 |
| 3,816,904 | 6/1974 | Herb | 483/29 |
| 4,205,427 | 6/1980 | Koch et al. | 483/29 |
| 4,412,469 | 11/1983 | Hirata et al. | 83/552 |
| 4,437,224 | 3/1984 | Bredow | 72/446 X |
| 4,587,716 | 5/1986 | Bytow | 83/563 X |
| 4,649,622 | 3/1987 | Scott | 483/29 |
| 4,901,427 | 2/1990 | Sakamoto et al. | 83/563 |
| 4,976,180 | 12/1990 | Otto | 83/133 |
| 5,048,385 | 9/1991 | Eckert et al. | 83/34 |

FOREIGN PATENT DOCUMENTS

| | | | |
|---|---|---|---|
| 388644 | 9/1990 | European Pat. Off. | 483/29 |
| 3907687 | 9/1989 | Fed. Rep. of Germany | 483/29 |
| 52-27393 | 7/1977 | Japan . | |
| 108422 | 4/1990 | Japan | 483/29 |
| 658609 | 11/1986 | Switzerland . | |
| 996166 | 2/1983 | U.S.S.R. | 483/28 |
| 1183871 | 3/1970 | United Kingdom . | |

*Primary Examiner*—William Briggs
*Attorney, Agent, or Firm*—Sandler, Greenblum & Bernstein

[57] ABSTRACT

A turret punch press includes rotatable upper and lower turrets, a striker which is vertically movable for striking a punch, a plate positioning device for moving and positioning, in the X and Y directions, a plate workpiece supported on a work table, and a tool changing device, wherein a punch holder magazine and a die holder magazine supporting respectively a punch and a die to be installed on the upper turret and the lower turret to replace the punch and die in use, are provided adjacent to the upper and lower turrets. The punch changing position on the upper turret is below the punch holder magazine, and the die changing position on the lower turret is above the die holder magazine. The tool changing device is positioned on a vertical line between the punch and die changing positions so that the punches and dies can be changed by a direct linear operation.

24 Claims, 14 Drawing Sheets

TURRET PUNCH PRESS

BACKGROUND OF THE INVENTION

1. Field of the Invention

The present invention relates to a turret punch press provided with an automatic tool changer.

2. Description of the Prior Art

Conventionally, a commonly known turret punch press comprises a freely rotatable upper turret for supporting a freely detachable punch; a freely rotatable lower turret for supporting a freely detachable die for processing a plate-type workpiece in conjunction with the punch; a striker with free vertical movement for striking a punch which has been indexed in a work position; and a plate positioning device for moving and positioning a plate workpiece to be processed by the punch and die in the X, Y directions while supported on a work table. Then, from a plurality of punches and dies mounted on the upper and lower turrets, the required punch and die are selected to perform punching operations of various shapes and sizes on the plate workpiece.

However, the number of punches and dies mounted on the upper and lower turrets is limited by the size and the like of the upper and lower turrets. For this reason, a turret punch press provided with a so-called automatic tool changer (ATC) on which a tool magazine and a tool changing device are positioned adjacent to the turret punch press is also well known. At the present time, various types of ATC mechanisms are known, such as a rotary-type tool magazine, a rotary and longitudinally movable system, a cylindrical coordinates-type robot system, and the like.

However, the ATC mechanism in a conventional turret punch press provided with an ATC is very complicated and therefore takes time for preparation and tool changing. Therefore, under existing conditions the desirably short time for preparation and tool changing is not available. As a result, such a mechanism is unable to cope with multi-variety, small volume production automatically and flexibly.

SUMMARY OF THE INVENTION

An object of the present invention is to provide, with due consideration to the drawbacks of such conventional devices, a turret punch press provided with a tool changing device by which both the preparation time and the time required to change the molds is reduced, and which is capable of automatically coping with multi-variety, small-volume production, with a high degree of flexibility.

This object is achieved in the present invention by the provision of a turret punch press comprising a freely rotatable upper turret for detachably supporting a punch; a freely rotatable lower turret for detachably supporting a die which processes a plate-type workpiece in collaboration with the punch; a striker with free vertical movement for striking a punch which has been indexed in a work position; a plate positioning device for freely moving and positioning, in the X, Y directions, the plate workpiece, supported on a work table; a tool changing device for detaching and changing the punch and the die on the upper and lower turrets respectively; a punch holder magazine, adjacent to the upper turret, for supporting a punch which is to be detached and changed at the upper turret; and a die holder magazine, adjacent to the lower turret, for supporting a die which is to be detached and changed at the lower turret; wherein a punch changing position on the upper turret is below the punch holder magazine, a die changing position on the lower turret is above the die holder magazine, and the tool changing device is positioned on a vertical line between the punch and die changing positions so that the punches and dies can be changed by a direct linear operation.

This object is further achieved in the present invention by the provision of a turret punch press comprising a freely rotatable upper turret for detachably supporting a punch; a freely rotatable lower turret for detachably supporting a die which processes a plate-type workpiece in collaboration with the punch; a striker with free vertical movement for striking a punch which has been indexed in a work position; a plate positioning device for freely moving and positioning, in the X, Y directions, the plate workpiece, supported on a work table; a tool changing device for detaching and changing the punch and the die on the upper and lower turrets respectively; a sub-frame adjacent to a main frame of the punch press on which the striker is mounted, and a plurality of freely detachable tool holders for supporting, in a punch holder magazine and a die holder magazine supported on the sub-frame, a punch and a die respectively, to be detached and changed wherein the tool changing device is provided on the sub-frame.

In the above-mentioned turret punch press, the upper turret which supports the punch, and the lower turret which supports the die are shaped as rectangular members; a semicircular auxiliary table provided with a support member which supports a plate workpiece is provided on a side section of the lower turret; and a plurality of pinions are provided on a rotatable shaft on the lower turret, each pinion engaged by a separate freely reciprocating rack.

By adoption of the turret punch press on the present invention, when the punches and dies mounted on the upper and lower turrets have been indexed in the work position, a plate workpiece, while being supported on a work table, is moved in the X- and Y-axis directions by means of a plate moving and positioning device, and is positioned at the work position in the desired attitude. In this state, the punch and die together perform the punching process through the vertical movement of the striker, with the plate workpiece positioned in the desired attitude.

During this punching operation, the punch and die required for the next punching operation are selected from the respective punch and die magazines provided adjacent to the turret punch press, and positioned in the punch and die changing positions on the upper and lower turrets respectively.

In this state, the punches and dies are directly changed in a direct linear operation by the tool changing device positioned on a vertical line between the punch and die changing positions. The time required for preparation and changing of the punches and dies is therefore considerably less than the time required in a conventional turret punch press.

BRIEF DESCRIPTION OF THE DRAWINGS

These and other objects, features, and advantages of the present invention will become more apparent from the following description of the preferred embodiment taken in conjunction with the accompanying drawings, in which.

DETAILED DESCRIPTION OF THE PREFERRED EMBODIMENTS

Other features of this invention will become apparent in the course of the following description of exemplary embodiments which are given for illustration of the invention and are not intended to be limiting thereof.

Figure 1:
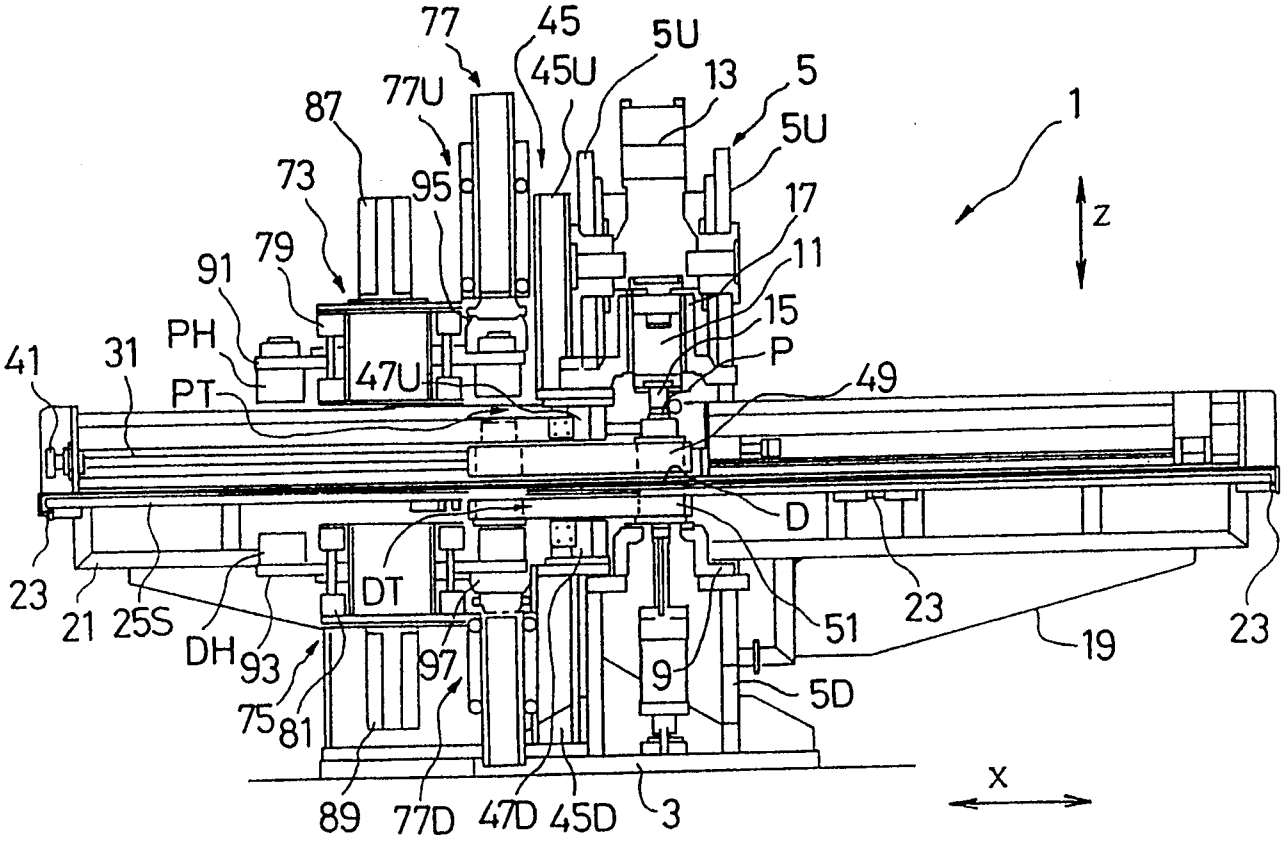
FIG. 1 is a right side elevation of one embodiment of a turret punch press provided with a tool changing device of the present/invention.
Figure 2:
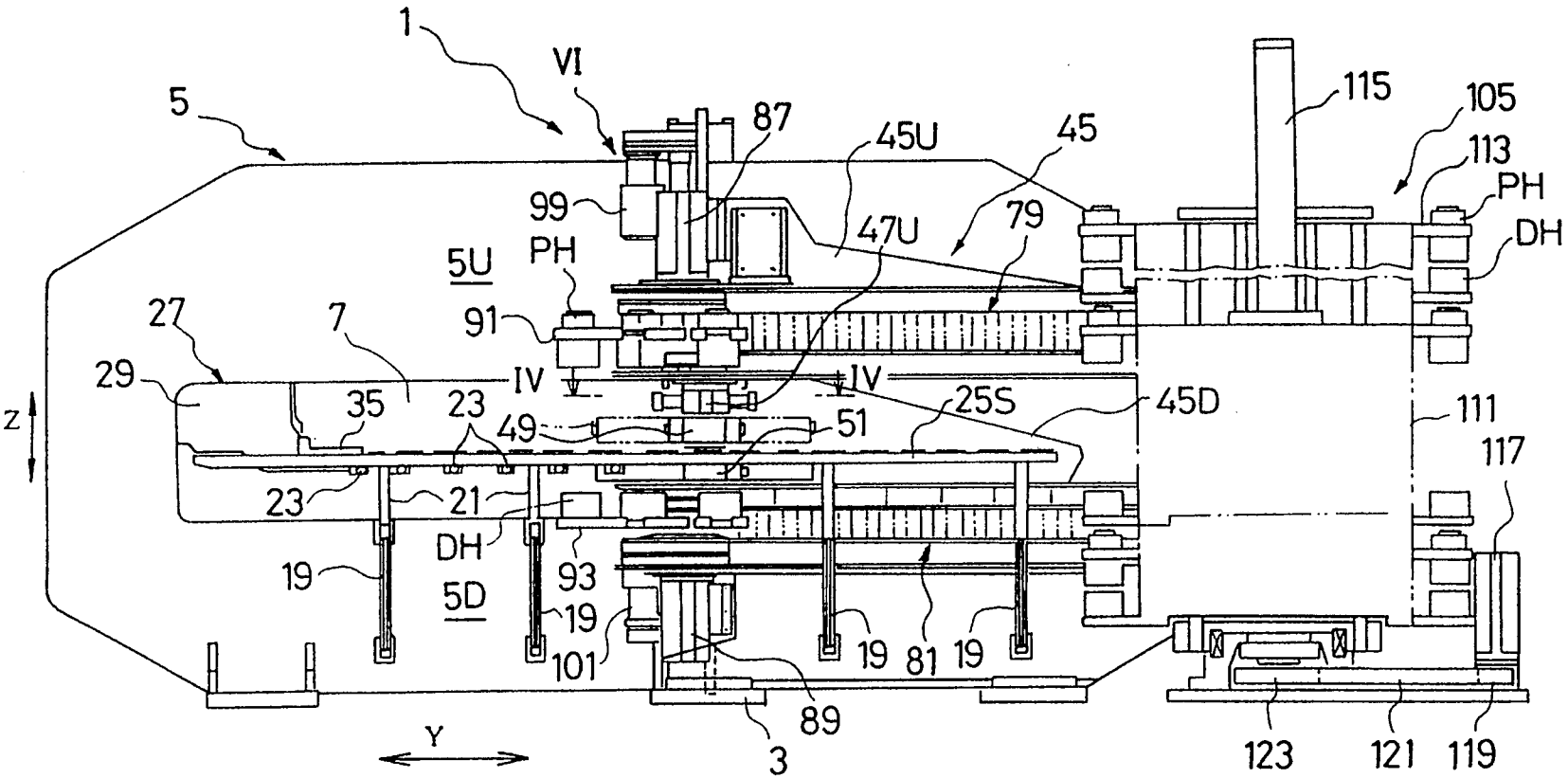
FIG. 2 is a front elevation of the embodiment of a turret punch-press of FIG. 1.
Figure 3:
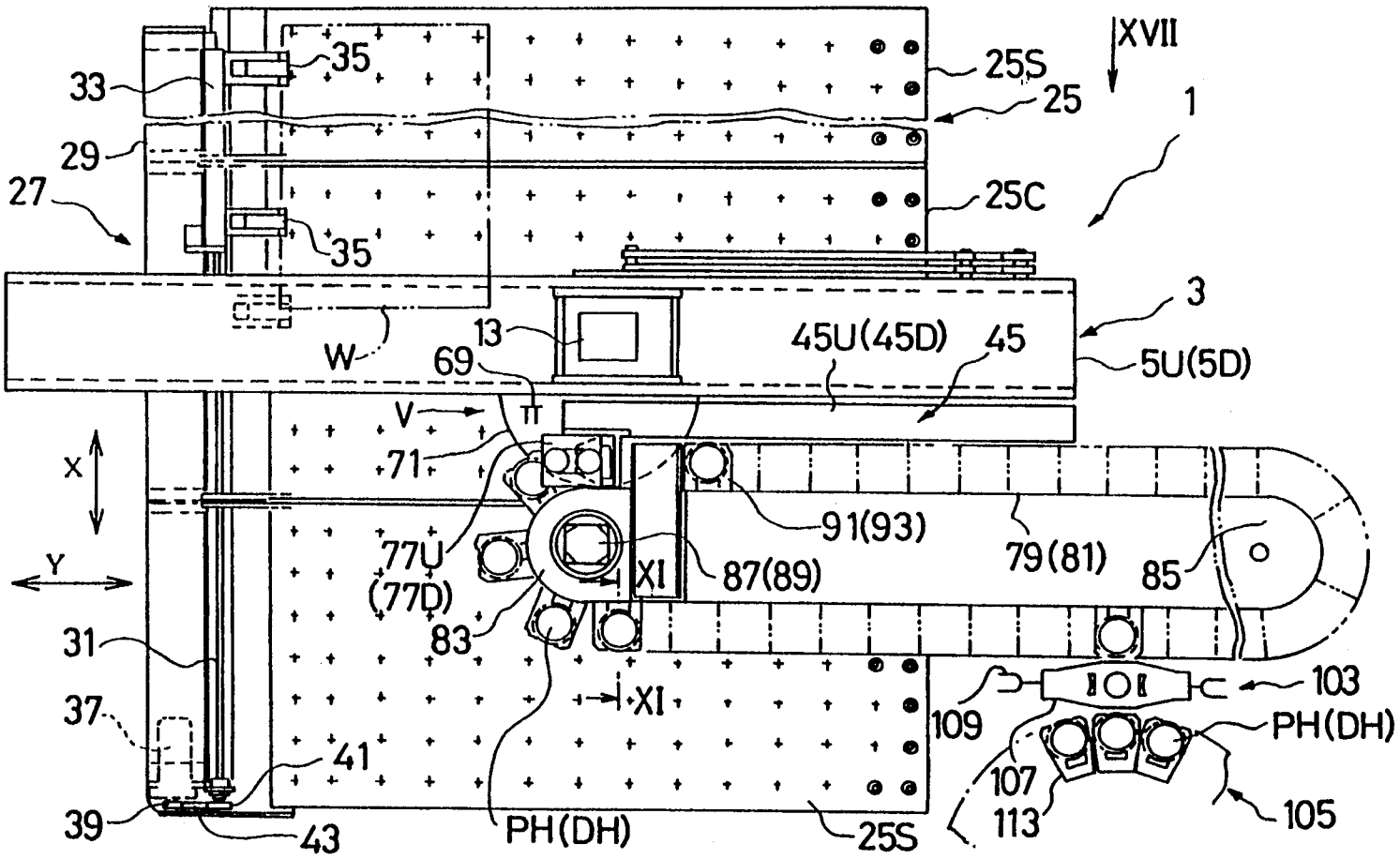
FIG. 3 is a plan view of the embodiment of a turret punch press of FIG. 1.

Now referring to FIGS. 1, 2, and 3, a turret punch press 3 is provided with a common base 3, and a gate-shaped main frame 5 is erected on the common base 3. The main frame 5 comprises an upper frame 5U with an opening section 7 and a lower frame 5D. A disk support 9 for receiving the force of the press is provided at a work position on the lower frame 5D.

A drive device 13, such as a hydraulic cylinder, a crank drive, a servo drive, or the like is provided on the upper frame 5U of the main frame 5 for providing vertical movement to a ram 11. A striker 15 is provided on the bottom of the ram 11. The ram 11 Is guided in a ram guide member 17 mounted on the upper frame 5U, allowing the ram 11 to slide in the Z-axis direction (the vertical direction in FIG. 1 and FIG. 2).

With this configuration, applying power to the drive device 13 causes the ram 11 to move in the Z-axis direction, guided by the ram guide member 17, thereby causing the striker 15 to move vertically.

A plurality of brackets 19 which extend in the Z-axis direction is provided, each bracket 19 mounted on the lower frame 5D of the main frame 5 at a suitable spacing in the Y-axis direction (the left-right direction in FIG. 2 and FIG. 3). A plurality of support frames 21 are provided, each support frame 21 mounted on a bracket 19. A freely movable side table 25S of a work table 25 is provided on the support frames 21, and moves in the Y-axis direction through a plurality of balls 23. The work table 25 comprises a pair of the side tables 25S provided one on each side of a fixed center table 25C.

A carriage base 29, which forms part of a workpiece positioning device 27, is provided on the left side of the work table 25 in FIG. 3. A freely rotatable ball screw 31 extending in the X-axis direction (the lateral direction in FIG. 1; vertical direction in FIG. 3) is supported on the carriage base 29. A carriage 33, which is freely movable in the X-axis direction, is provided on the ball screw 31 through a nut member. A plurality of work clamps 35 are provided on the carriage 33 for clamping a plate workpiece W to the carriage 33.

An X-axis motor 37 is provided on the lower part of the carriage base 29, as shown in FIG. 3, and a drive pulley 39 is mounted on the output shaft of the X-axis motor 37. A follower pulley 41 is mounted on one end of the ball screw 31, and a timing belt 43 is fitted around the follower pulley 41 and the drive pulley 39.

With this configuration, when a Y-axis motor (omitted from the drawings) is operated, the side table 25S is moved with the carriage base 29 in the Y-axis direction through the balls 23 supported on the support frame 21. Also, when the X-axis motor 37 is operated, the carriage 33 is moved in the X-axis direction, by the rotation of the ball screw 31 through the nut member, via the drive pulley 39, the timing belt 43, and the follower pulley 41. Accordingly, the plate workpiece W is moved in the X- and Y-axis directions while clamped in the work clamp 35, and the workpiece W is positioned below the striker 15 at the work position, in the desired attitude.

A sub-frame 45 is erected on the common base 3 adjacent to the main frame 5. The sub-frame 45 is formed in a C-shape and comprises an upper frame 45U and a lower frame 45D. A freely rotatable upper turret 49 with, for example, a rectangular shape, and a freely rotatable lower turret 51 also with, for example, a rectangular shape, are supported through an upper rotary shaft 47U on the lower part of the upper frame 45U, and through a lower rotary shaft 47D on the upper part of the lower frame 45D respectively.

A punch holder PH, on which is mounted a punch P, is detachably installed on each side of the upper turret 49, and a die holder DH on which is mounted a die D corresponding to the punch P, is detachably installed on each side of the lower turret 51.

Figure 4:
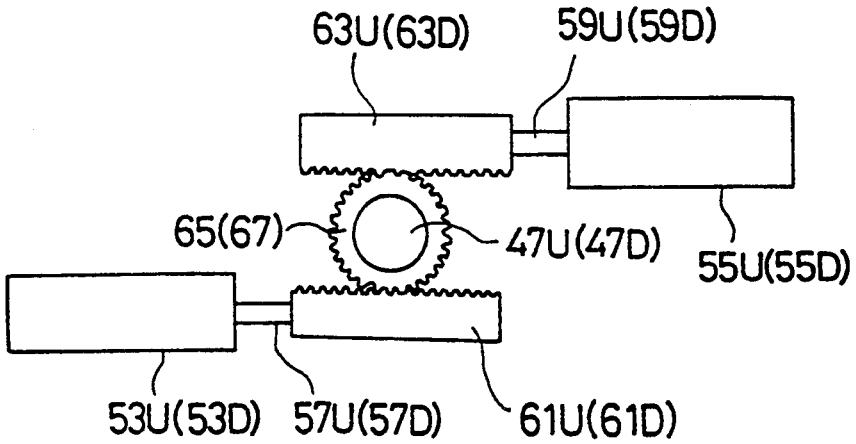
FIG. 4 is an enlarged view taken along the line IV—IV in FIG. 2.

Rotary drive means, such as, for example, a plurality of hydraulic cylinders 53U, 53D, 55U, 55D which cause the upper and lower rotary shafts 47U, 47D to rotate, are provided on the inner sides of the upper and lower frames 45U, 45D in the lateral direction in FIG. 2, as shown in FIG. 4. A plurality of racks 61U, 61D, 63U, 63D is provided, each rack integrally attached to the end of one of a plurality of piston rods 57U, 57D, 59U, 59D installed in the hydraulic cylinders 53U, 53D, 55U, 55D respectively. A pair of pinions 65, 67 into each of which is inserted one of a pair of upper and lower rotary shafts 47U, 47D respectively engage the racks 61U, 61D; 63U, 63D respectively.

With this configuration, when the hydraulic cylinders 53U, 53D, 55U, 55D are operated, the piston rods 57U, 57D, 59U, 59D are moved in the lateral direction in FIG. 4 so that the upper and lower rotary shafts 47U, 47D are synchronously rotated in the same direction through the racks 61U, 61D; 63U, 63D and the pinions 65, 67. Accordingly, the upper and lower turrets 49, 51 can be rotated at high speed with a simple construction, and can be manufactured at low cost. In addition, the upper and lower rotary shafts 47U, 47D may be rotated using a drive motor, a worm, a worm wheel, or the like as the rotary drive means.

Figure 5:
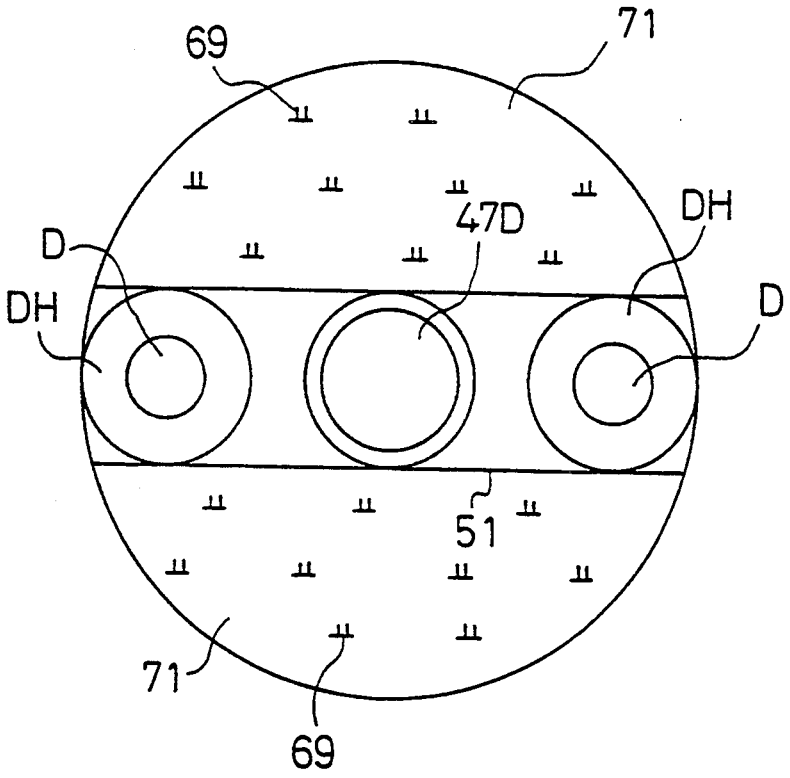
FIG. 5 is an enlarged view taken in the direction of the arrow V in FIG. 3.

As shown in FIG. 5, two semicircular auxiliary tables 71 equipped with a support member 69, such as a brush or the like which supports the workpiece W, is fixed on both sides of the lower turret 51. Accordingly, a downward forming process is made possible, and damage produced in the workpiece W resulting from the rotation of the lower turret can be minimized.

With this configuration, the punch P and the die D selected and indexed on the upper and lower turrets 49, 51 from the rotation of the upper and lower rotary shafts 47U, 47D can be positioned at the work position. Next, the punch P and the die D are used in collaboration to punch the workpiece W at the desired position on the workpiece.

The punching process is implemented in this manner through the freely vertical action of the ram 11, which generates heat at a part of the upper frame 5U. The heat cannot be transferred to the upper and lower frames 45U, 45D where the upper and lower turrets 49, 51 are supported since frames 45U, 45D are positioned away from the upper frame 5U. Thus, there is no larger heat effect which may cause misalignment of turrets 49, 51.

A punch holder magazine 73 which supports the punch P which is to be detached and changed, on the upper turret 49, and a die holder magazine 75 which supports the die D which is to be detached and changed, on the lower turret 51, are provided adjacent to the left side in FIG. 1 of the upper and lower frames 45U, 45D of the sub-frame 45. A punch changing position PT of the upper turret 49, as shown in FIG. 1, is situated under the lower part of the punch holder magazine 73, and a die changing position DT of the upper turret 49, also as shown in FIG. 1, is situated over the upper part of the die holder magazine 75. This way, an upper tool changing device 77U and a lower tool changing device 77D of a tool changing device 77 are positioned on a vertical line between the punch and die changing positions PT, DT.

The punch holder magazine 73 and the die holder magazine 75 are positioned in opposition in the vertical direction, and, as shown in FIG. 3, a pair of endless chain members 79, 81 are fitted around a drive sprocket 83 and a follower sprocket 85. A pair of drive motors 87, 89 such as servo motors are linkingly connected to the drive sprocket 83. A plurality of pairs of clamp hooks 91, 93 which clamp the punch holder PH and the die holder DH respectively in relative opposition, are installed endlessly on the chain members 79, 81.

A pair of chuck hooks.-95, 97 which clamp the punch holder PH and the die holder DH is provided on the lower parts of the upper and lower mold changing devices 77U, 77D respectively. In addition, the upper and lower mold changing devices 77U, 77D are moved vertically by a pair of changer drive motors 99,101, which may be servo motors, installed on the upper and lower frames 45U, 45D of the sub-frame 45.

With this configuration, while the punch P and the die D are punching the workpiece W in collaboration at the work position, the upper and lower tool changing devices 77U, 77D are moved vertically in the punch holder PH and the die holder DH to the punch change position PT and the die change position DT by the changer drive motors 99,101. The punch holder PH and the die holder DH mounted on the upper and lower turrets 49, 51 are withdrawn by the chuck hooks 95, 97, and installed in the punch holder magazine 73 and the die holder magazine 75 respectively. Then, the punch holder PH and the die holder DH are withdrawn from the punch holder magazine 73 and the die holder magazine 75 by the chuck hooks 95, 97 and installed on the upper and lower turrets 49, 51. By performing this series of operations between the punch and die changing positions PT, DT, and the punch and die holder magazines 73, 75, as a linear operation on a vertical line between the upper and lower tool changing devices 77U, 77D, the punch holder PH and the die holder DH can be changed expeditiously so that the time required for both the preparation and the changing of the punches and dies is therefore considerably less than the time required in a conventional turret punch press. Accordingly, the turret punch press of the present invention can automatically cope with multiple-variety, small-volume production, with a high degree of flexibility, and, by extension, unmanned operation is possible.

A commonly known regular die changing device 103, formed from two arms, and a tooling tower 105 are provided at the changing positions for the punch and die holder magazines 73, 75, as shown in FIG. 2 and FIG. 3. In the die changing device 103, a clamp hook 109 which can pivot 90° and 180° is installed on the ends of a pair of arms 107. Because a device with a commonly known structure has been adopted here, a detailed explanation is omitted. In addition, a clamp hook 113 is provided on both the tooling tower 105 and the outer periphery of a cylindrical member 111 in a plurality of stages, and the punch holder PH and the die holder DH are clamped to the clamp hook 113. The cylindrical member 111 is capable of free rotatability and free vertical motion. Specifically, the cylindrical member 111 is moved vertically by the operation of a hydraulic cylinder 115 and is rotated by a servo motor 117 through a drive pulley 119, a timing belt 121, and a follower pulley 123. Accordingly, an exchange of the punch holder PH and the die holder DH occurs between the punch and die holder magazines 73, 75 and the tooling tower 105.

The specific structure of the upper tool changing device 77U will now be explained, but since the lower tool changing device 77D is almost identical to the upper tool changing device 77U, except that the elevation and descent operations are reversed, and explanation is omitted here.

Figure 6:
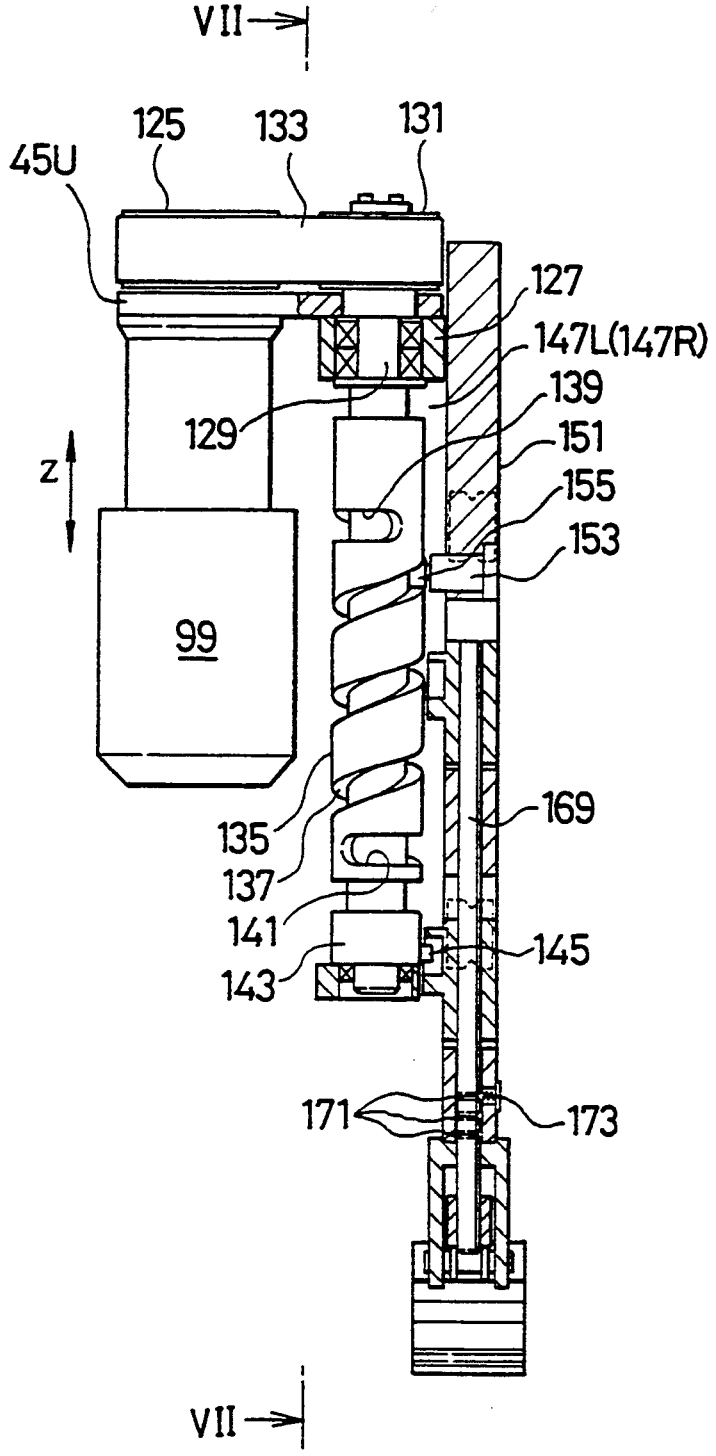
FIG. 6 is an enlarged view taken in the direction of the arrow VI in FIG. 2.
Figure 7:
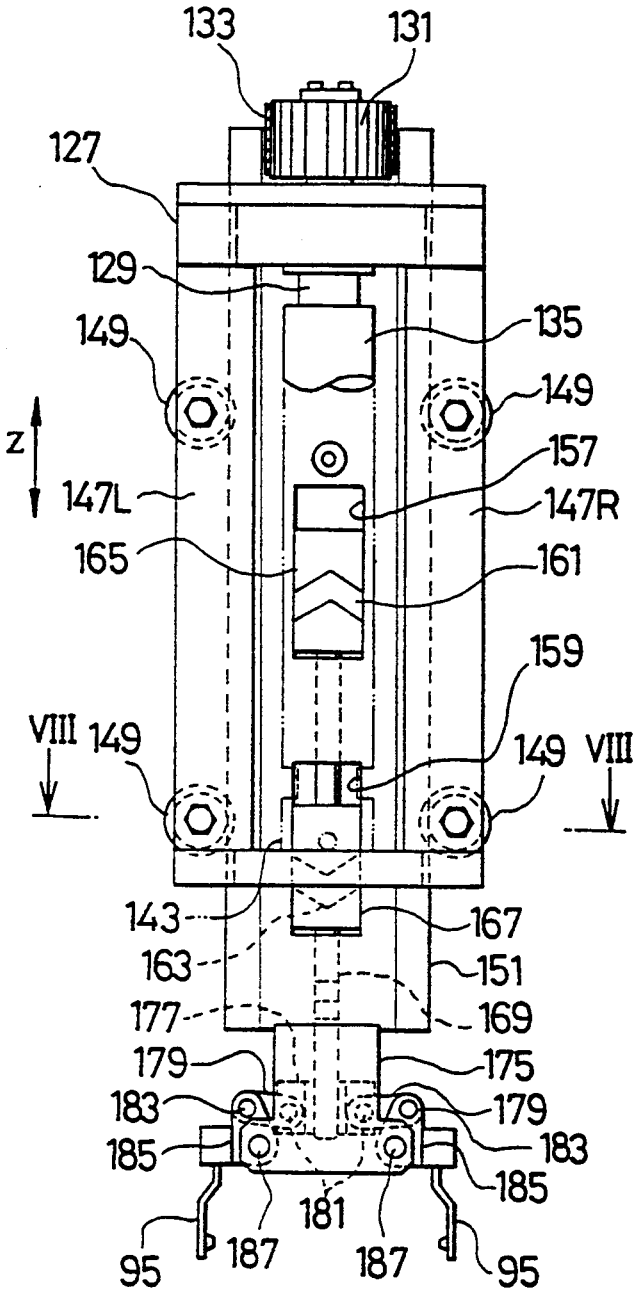
FIG. 7 is a view taken along the line VII—VII in FIG. 6.
Figure 8:
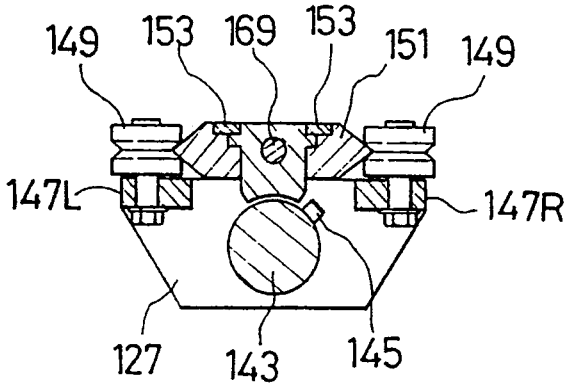
FIG. 8 is a sectional view of an example of an upper tool changing device taken along the line VIII—VIII in FIG. 7.

Now referring to FIGS. 6, 7, and 8, the drive motor 99 is mounted on the upper frame 45U of the sub-frame 45 and a drive pulley 125 is mounted on the output shaft of the drive motor 99. A support block 127 is installed on the upper frame 45U and a rotary shaft 129 extending in the Z-axis direction (upward) is mounted on the support block 127. A follower pulley 131 is installed on the end of the rotary shaft 129. A timing belt 133 is fitted to the drive pulley 125 and the follower pulley 131.

With this configuration, when the drive motor 99 is operated the drive pulley 125 is rotated by the output shaft of the motor 99. The rotary shaft 129 is then caused to rotate through the timing belt 133 and the follower pulley 131.

The rotary shaft 129 is inserted into a spindle 135 extending in the Z-axis direction, and a spiral grooved cam 137 is formed at a uniform pitch in the outer peripheral surface of the spindle 135. A pair of horizontal grooves 139,141 is formed in the spindle 135, and these grooves 139, 141 are connected to the upper and lower parts of the cam 137 respectively. The lower part of the spindle 135 is fitted into a hollow cylindrical member 143, and a cam follower 145 is provided on the hollow cylindrical member 143.

A pair of vertical support plates 147R, 147L is provided, hanging down from opposite sides of the support block 127. A guide member 149 comprising a plurality of freely rotatable rollers is provided on a vertical face of each of the support plates 147R, 147L. A clamp member 151 freely movable in the Z-axis direction is guided between the guide members 149.

A support block 153 provided on the clamp member 151 is provided with a cam follower 155. The cam follower 155 engages the cam 137 and is provided capable of freely rolling on the surface of the cam 137.

A pair of grooves 157,159 is provided, each groove formed in upper and lower portions of the clamp member 151. A pair of engaging blocks 165,167 is provided, engaging with the respective grooves 157, 159. The engaging blocks 165, 167 are provided with a cam 161 and a cam 163 respectively which can engage the cam follower 145. The cams 161,163 can be formed, for example, in the shapes schematically illustrated in FIGS. 9(A), 9(B).

A pull rod 169 which extends in the Z-axis direction is connected to the engaging blocks 165, 167, and a groove 171 is provided on the lower part of the pull rod 169 at a suitable spacing. A plunger 173 which engages the groove 171 is provided on the clamp member 151, and is positioned by the clamp member 151.

A support frame 175 is provided on the lower end of the clamp member 151, and a slide member 177 integrally formed with the pull rod 169 is provided on a lower part of the support frame 175 with free movement in the Z-axis direction. One end of each of a plurality of links 179 is secured to the slide member 177 by a pin 181. The other end of each link 179 is secured to one end of a collet 185 by a pin 183. The other end of each collet 185 is supported in a freely rotatable manner on the support frame 175 by a pin 187. The base of the-chuck hook 95 is also installed on the collet 185.

From this configuration, when the rotary shaft 129 rotates, the spindle 135 is rotated in the same direction. The cam follower 155 which engages the cam 137 formed in the spindle 135 rolls along the cam 137 from the rotation of the spindle 135, so that the clamp member 151 moves vertically.

When the cam follower 155 penetrates the horizontal grooves 139,141 which interconnect the upper and lower parts of the cam 137, the clamp member 151 is halted at either the upper or lower end of the cam 137. When the clamp member 151 is halted at either the upper or lower end of the cam 137, the second cam follower 145 engages either the cam 163 or the cam 161.

Figure 9A:
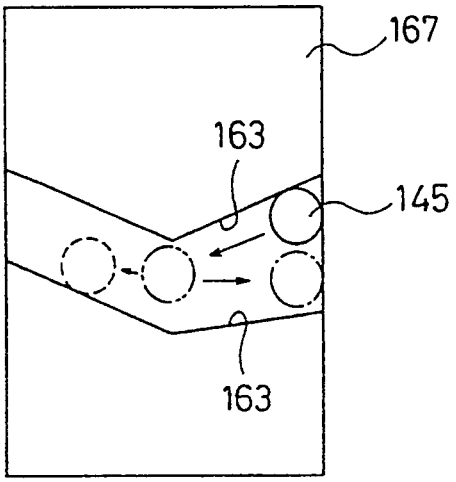
FIGS. 9A and 9B are diagrams showing an example of the shape of a cam in an engagement block mounted on a pull-rod.

At the upper end of the clamp member 151, for example, the second cam follower 145 penetrates the cam 163 and push up the surface of the cam 163 while moving in the direction of the arrows, as illustrated in FIG. 9(A), then halts at a position indicated by the two-point chain line. Specifically, in this state, when the pull rod 169 is pulled upward, the link 179 is rotated upward with the pin 183 as a fulcrum, as shown in FIG. 7, and the collet 185 is rotated outward with the pin 187 as a fulcrum, so that the chuck hooks 95 are unclamped from the punch holder PH. Then, when the spindle 135 rotates in reverse and the clamp member 151 is caused to descend from the upper end, the cam follower 145 returns to the position indicated by the one-dot chain line in FIG. 9(A), and the pull rod 169 does not move since the cam follower does not abut the cam surface. The chuck hook 95 therefore descends while remaining in the unclamped state.

When the cam follower 145 reaches the position indicated by the two-dot chain line in FIG. 9(A) and the spindle 135 rotates in the same direction, the cam follower 45 moves along the surface of the cam 163 to the position indicated by the dotted line, and the pull rod 169 moves downward. Specifically, when the pull rod 169 moves downward, the link 179 is rotated downward with the pin 183 as a fulcrum, and the collet 185 is rotated inward with the pin 187 as a fulcrum. The chuck hooks 95 therefore clamp the punch holder PH. In this state, when the clamp member 51 descends, the punch holder PH also descends while clamped by the chuck hooks 95.

Figure 9B:
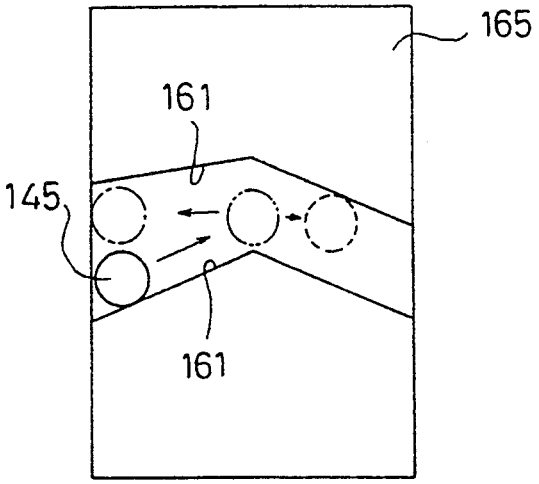

In the same manner, at the lower end of the clamp member 151, the second cam follower 145 penetrates the cam 61, push down the surface of the cam 161 while moving in the direction of the arrows, as illustrated in FIG. 9(B), and halts at a position indicated by the two-point chain line. Specifically, in this state, the pull rod 169 moves downward, and the punch holder PH is clamped by the chuck hooks 95 in the same manner as stated above. Also, when the cam follower 145 is at the position indicated by the two-point chain line in FIG. 9(B), and the spindle 135 is rotated slightly in the same direction, the cam follower 145 moves along the surface of the cam 161 to the position indicated by the dotted line. The pull rod 169 moves upward. Specifically, because the pull rod 169 moves upward, the chuck hooks 95 are unclamped from the punch holder PH in the same manner as stated above.

The operation of exchanging the punch holder PH between the upper turret 49 and the punch holder magazine 73 using the upper tool changing device 77U will now be explained. First, the punch holder PH is set at the punch changing position PT of the upper turret 49, and the chuck hooks 95 are unclamped. In this state, when the drive motor 99 is operated and the spindle 135 rotates, the clamp member 151 descends. The cam follower 145 engages the second cam 161, and moves along the cam surface to the position indicated by the two-point chain line in FIG. 9(B). The pull rod 169 then descends and the punch holder PH is clamped by the chuck hooks 95.

In this state, when the spindle 135 rotates in reverse, the clamp member 151 ascends and the second cam 163 engages the cam follower 145 which moves along the cam surface. When the cam follower 145 reaches the position indicated by the two-point chain line in FIG. 9(A), the pull rod 169 ascends, the chuck hooks 95 are unclamped, and the punch holder PH is installed in the punch holder magazine 73.

Next, the punch holder magazine 73 is rotated, and a new punch holder PH is positioned in the changing device. In this state, the spindle 135 is moved in the same direction, and when the cam follower 145 reaches the position indicated by the two-point chain line in FIG. 9(A), the pull rod 169 descends and the chuck hooks 95 are closed to clamp the punch holder PH.

In this state, the clamp member 151 descends and the second cam follower 145 engages the cam 161. Then, the punch holder PH while clamped in the chuck hooks 95 is installed on the upper turret 49.

With the punch holder PH installed on the upper turret 49, when the second cam follower 145 reaches the position indicated by the dotted line in FIG. 9(B), the pull rod 169 ascends and the chuck hooks 95 are unclamped from the punch holder PH. Because the spindle 135 rotates in reverse, the clamp member 151 ascends with the chuck hooks 95 in the unclamped state and one series of mold changing is completed.

Accordingly, by utilizing the tool changing device 77 a reliable, high speed tool changing operation can be performed without the necessity for servo motor controls, limit switch signals, sequencers, and the like. Further, in this embodiment of the present invention, it is possible for the cam follower 145 to be situated at the pull rod side and the second cams 161,163 to be situated on the cam 135 side without departing from the spirit of the invention.

Figure 10:
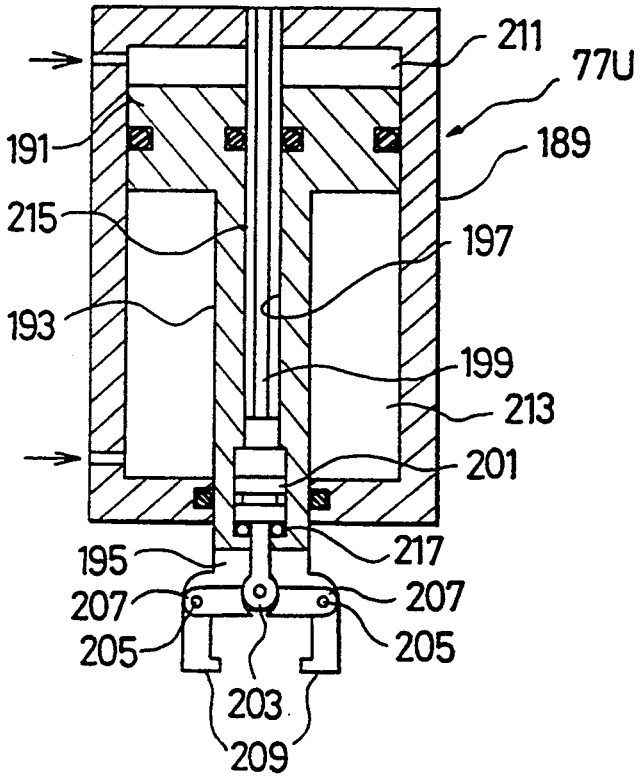
FIG. 10 is a sectional view of an example of another embodiment of an upper tool changing device.

The configuration of another embodiment of the upper tool changing device 77U of the tool changing device 77 is shown in detail in FIG. 10. The lower tool changing device 77D is almost identical to the upper mold changing device 77U except that the elevation and descent operations are reversed, therefore no further explanation will be given here.

Now referring to FIG. 10, the upper tool changing device 77U is provided with a hydraulic cylinder 189. The hydraulic cylinder 189 is mounted on the upper frame 45U of the sub-frame 45 which has been omitted from the drawing. A piston 191 is provided in the hydraulic cylinder 189, and a piston rod 193 which is extended-vertically projects from and is integrally formed with the piston 191. A support block 195 is provided at the lower end of the piston rod 193.

A hole 197 is formed penetrating both the piston 191 and the piston rod 193 in the vertical direction. A vertical pull rod 199 is provided which penetrates the hole 197. A piston 201 is integrally formed part way along and a cam follower 203 is provided at the bottom end of the pull rod 199.

A pair of links 207 are provided, each of which is attached to opposite sides at the end of the support block 195 by a pair of pins 205. The other end of each link 207 engages the cam follower 203. In addition, a pair of chuck hooks 209 are provided, the upper ends being attached to the links 207 respectively through the pins 205.

With this configuration, when hydraulic pressure is applied to an upper cylinder chamber 211 formed at the boundary of the piston 191, the descent of the piston rod 193 via the piston 191 causes the chuck hooks 209 to descend. In addition, when hydraulic pressure is applied to a lower cylinder chamber 213 formed at the boundary of the piston 191, the elevation of the piston 191 causes the chuck hooks 209 to ascend.

When hydraulic pressure is applied to an upper cylinder chamber 215 formed at the boundary of the piston 201, the descent of the piston 201 causes the cam follower 203 to descend via the pull rod 199 so that the link 207 rotates toward the outer side, with the pin 205 as a fulcrum, and the chuck hooks 209 open to unclamp the punch holder PH.

When hydraulic pressure is applied to a lower cylinder chamber 217 formed at the boundary of the piston 201, the piston 201 is elevated, causing the pull rod 199 to be elevated. Accordingly, the cam follower 203 is elevated, the link 207 rotates toward the inner side with the pin 205 as a fulcrum and the chuck hooks 209 close to clamp the punch holder PH.

In this manner, by the opening or closing of the chuck hooks 209 at the punch P changing position and the punch holder magazine 73 changing position on the upper turret 49, the punch holder PH is clamped or unclamped by the chuck hooks 209 and changed. Accordingly, the same results are obtained as described for the previous embodiment.

The movement of the punch holder magazine 73 and the die holder magazine 75, as shown in FIG. 3, is implemented by means of the chain members 79 and 81 fitted to the drive sprocket 83 and the follower sprocket 85. The specific structure of the die holder magazine 75 is almost identical to that of the punch holder magazine 73. Therefore, an explanation of the punch holder magazine 73 will be given here, but an explanation of the die holder magazine 75 will be omitted.

Figure 11:
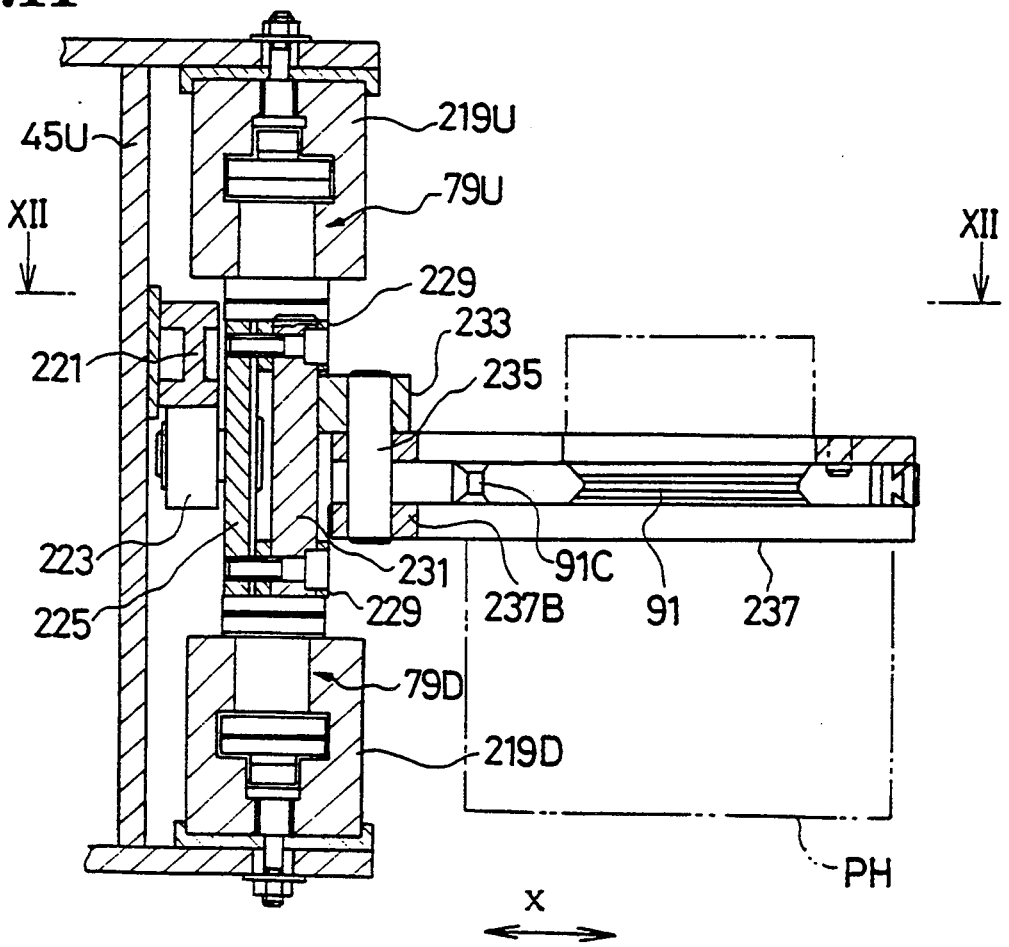
FIG. 11 is an enlarged view of an example of a punch holder magazine taken along the line XI—XI in FIG. 3.
Figure 12:
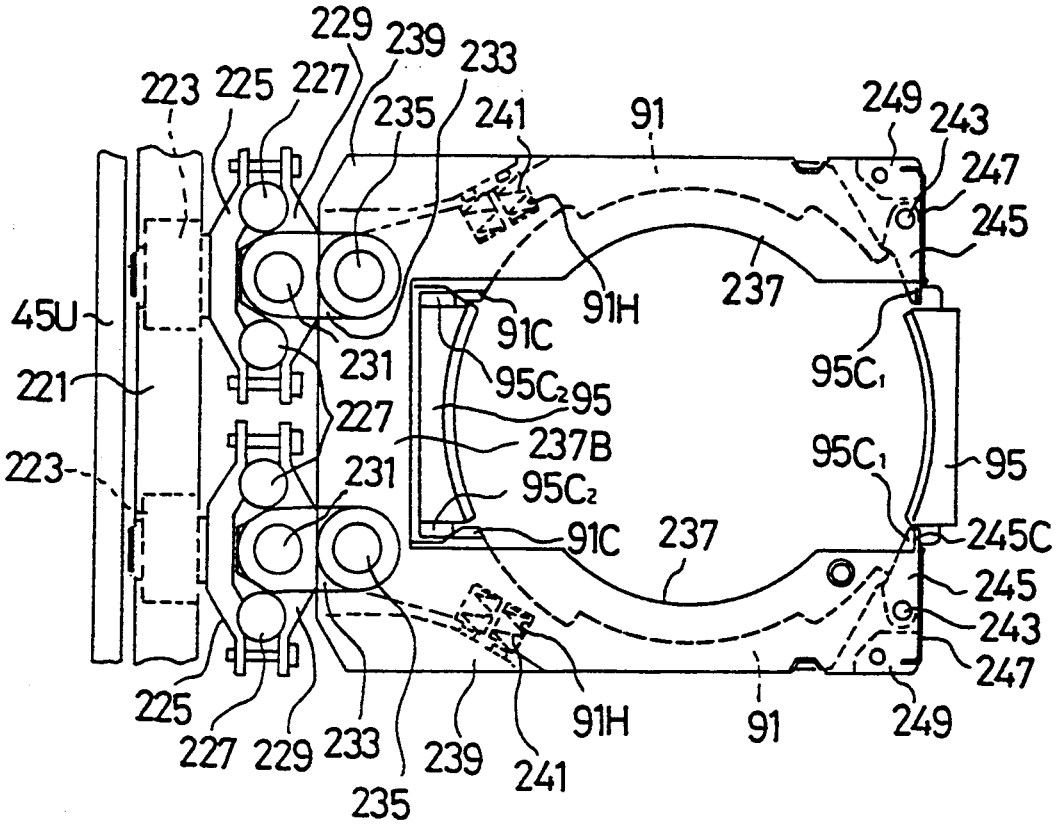
FIG. 12 is a view taken along the line XII—XII in FIG. 11.

More specifically, as shown in FIG. 11 and FIG. 12, an upper guide member 219U and a lower guide member 219D extending in the Y-axis direction (the direction perpendicular to the surface of the paper in FIG. 11) are provided on the upper frame 45U of the sub-frame 45. An upper and a lower chain member 79U and 79D of a chain member 79 are guidedly driven on the guide members 219U, 219D.

A block member 221 which extends in the Y-axis direction is provided on a perpendicular frame on the upper frame 45U. A plurality of rollers 223 is provided, each roller rotating and guidedly running on the bottom surface of the block member 221. A first clamp member 225 is provided on each roller 223. A second clamp member 229 is provided on the opposite side of the upper and lower end of the first clamp member 225 through a pin 227. The second clamp member 229 and the first clamp member 225 are secured by a plurality of bolts. The first and second clamp members 225, 229 are clamped in the upper and lower chain members 79U, 79D.

A vertically extending pin 231 is mounted on the second clamp member 229 as shown in FIG. 11. One end of a link 233 is engaged by the pin 231, and the other end of the link 233 is attached to the upper end of the pin 235. A base 237B of a clamp member 237 engages a lower part of a pin 235, and the clamp hooks 91 are pivotably supported on the base 237B of the clamp member 237 in a manner allowing free opening and closing.

A block member 239 positioned at the same height as the clamp hooks 91 is provided on the side of the base 237B of the clamp member 237. A plurality of springs 241 is provided for energizing the clamp hooks 91 normally to the inside. The springs 241 are interposed in a plurality of grooves 91H formed in the clamp hooks 91 at the inside end of the block member 239.

Figure 13:
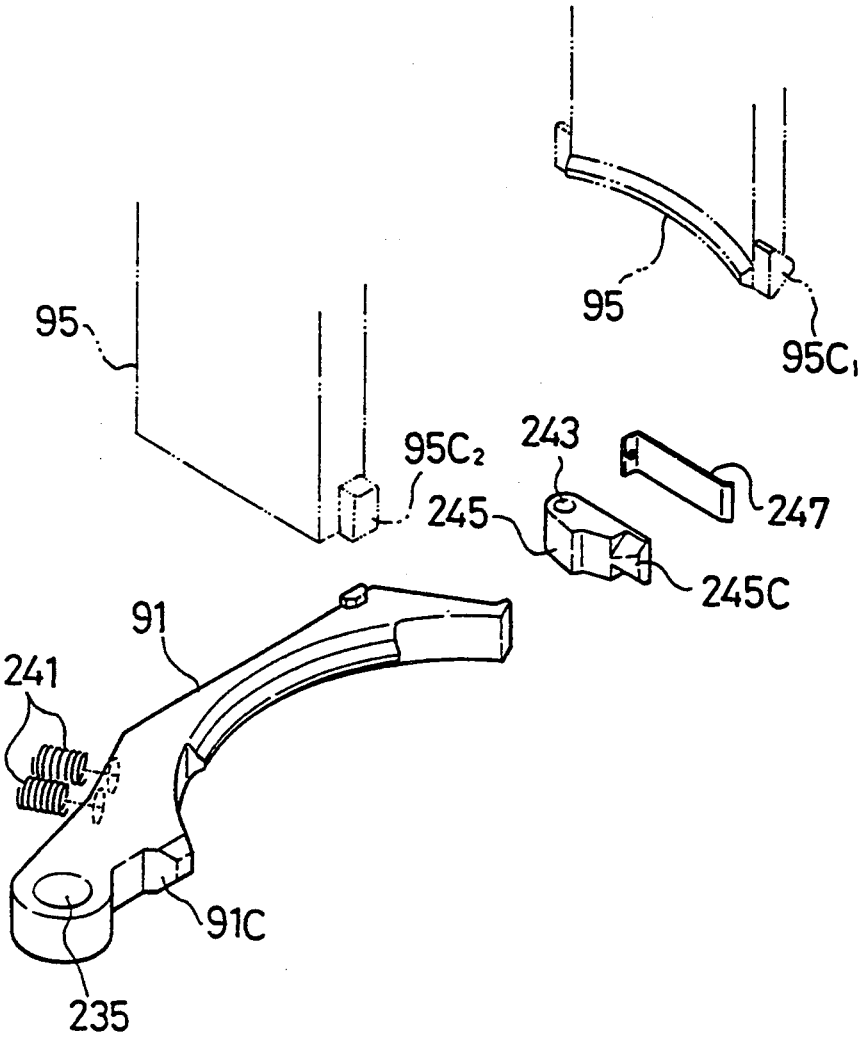
FIG. 13 is a perspective view of only one clamp hook illustrated in FIG. 12.

A stopper member 245 pivotably supported in a freely swinging manner by a pin 243, and a block member 249 fitted with a plate spring 247 are provided on the forward end (upper and lower right end in FIG. 12) of the clamp member 237. A cam surface 245C is formed at the end of the stopper member 245 as shown in FIG. 13. Specifically, the cam 245C is guided on a cam surface $95C_1$ formed at the end of the chuck hook 95 on the upper tool changing device 77U, and the stopper member 245 pivots outward in FIG. 12, against the energization force of a plate spring 247, with the pin 243 as a fulcrum.

A clamp cam 91C is formed on the inner rear side surface of the clamp 91. The clamp cam 91C presses on a cam surface $95C_2$ formed on the chuck hooks 95, and the clamp hook 91 opens against the energization force of the spring 241 with the pin 235 as a fulcrum.

With this configuration, the clamp body 237 is positioned at the changing position by the travel drive of the chain member 79U, and the punch holder PH is clamped as shown in FIG. 11 by the clamp hooks 91 mounted on the clamp member 237. In this state, the chuck hooks 95 mounted on the upper tool changing device 77U are open and descend to enter the clamp member 237 in FIG. 12, and are positioned at the forward and rear ends of the clamp member 237, as shown in FIG. 14(A).

Figure 14A:
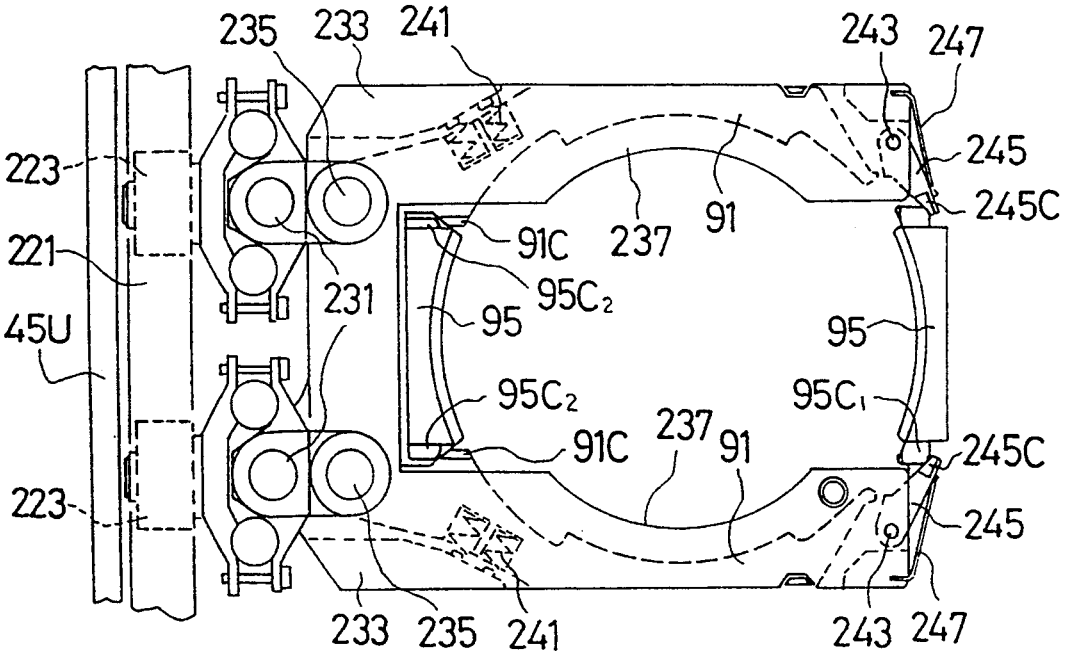
FIG. 14A and 14B are views for explaining a transfer operation of a punch holder from a chuck hook to a clamp hook, or from a clamp hook to a chuck hook.

In this state, as shown in FIG. 14(A), the cam surface $95C_1$ of the chuck hook 95 travels along a cam $245C_1$ of the stopper member 245, and by descending, the stopper member 45 is pivoted outward against the energization force of the plate spring 247 with the pin 243 as a fulcrum. Accordingly, the stopper member 245 is moved away from the clamp hook 91.

Figure 14B:
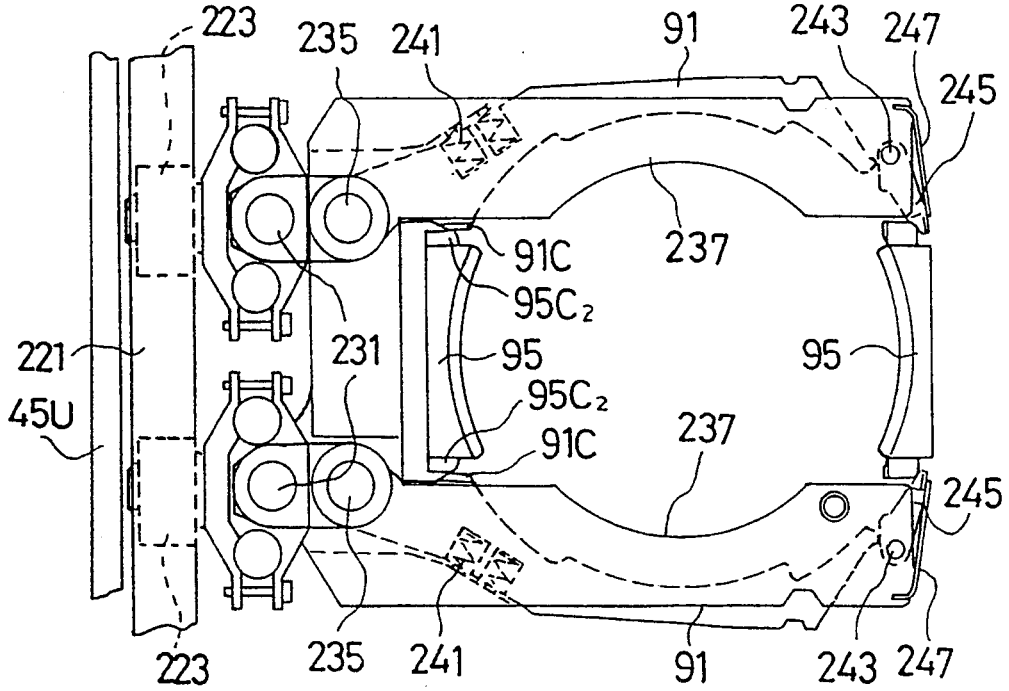

In the state shown in FIG. 14(A) the chuck hooks 95 are then closed. Specifically, the chuck hooks 95 move to the inside in the lateral direction. As shown in FIG. 14(B), because the cam $95C_2$ of the chuck hook 95 moves in the lateral direction along the cam 91C of the clamp hook 91, the clamp hook 91 opens outward against the energization force of the spring 241 with the pin 235 as a fulcrum.

Accordingly, the punch holder PH is unclamped by the clamp hooks 91, and becomes clamped by the chuck hooks 95. Specifically, the punch holder PH is directly transferred from the clamp hooks 91 to the chuck hooks 95 in a linear operation.

The punch holder PH descends while clamped in the chuck hooks 95 and is installed on the upper turret 49 at the punch changing position PT. After the punch holder PH has been installed on the upper turret 49 the empty chuck hooks 95 ascend and return to their original position.

In addition, the empty chuck hooks 95 descend, and when the punch holder PH which has been installed on the upper turret 49 at the punch changing position is lifted up in the clamped state and halts at the position of the clamp hooks 91, the cam $95C_2$ of the chuck hooks 95 opens up the cam 91C of the clamp hooks 91 and the cam $95C_1$ causes the stopper member 245 to pivot via the cam 245C of the stopper member 245 and assume the state shown in FIG. 14(B). In this state, when the chuck hooks 95 open, they enter the state shown in FIG. 14(A) and the clamp hooks 91 are closed from the energization force of the spring 241 with the pin 235 as a fulcrum.

Accordingly, the punch holder PH is transferred from the chuck hooks 95 to the clamp hooks 91. Also, when the chuck hooks 95 are elevated to the original position, the stopper member 245 is pivoted inward from the energization force of the plate spring 247 with the pin 243 as a fulcrum, and the clamps hooks 91 are secured.

In this manner, the chuck hooks 95 and the clamp hooks 91 are positioned at right angles, and the punch holder PH can be directly transferred from the chuck hooks 95 to the clamp hooks 91, or from the clamp hooks 91 to the chuck hooks 95 by the linear movement of the chuck hooks 95. Accordingly, in the tool changing device 77, the chuck hooks 95, 97 can pass through the punch and die holder magazines 73, 75 to force them open, thereby quickly changing the tools and achieving a compact construction.

Figure 15:
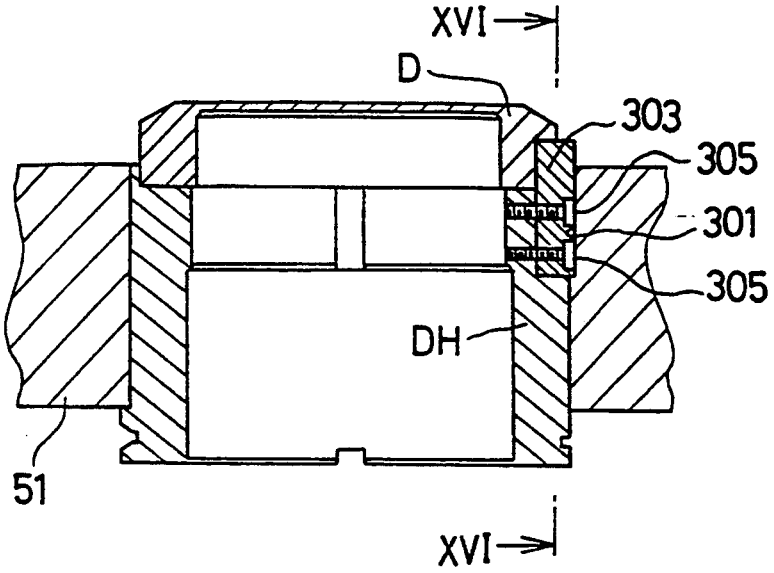
FIG. 15 is a sectional view of one example of a mounted die holder supporting a die on a lower turret.
Figure 16:
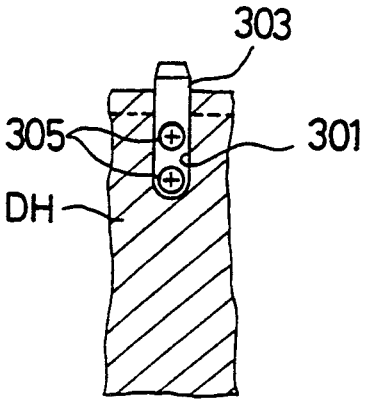
FIG. 16 is a sectional view taken along the line XVI—XVI in FIG. 15.

As shown in FIG. 15 and FIG. 16, the die holder DH which supports the die D in a freely changeable manner is mounted on the lower turret 51. A keyway 301 is formed in the lower turret 51. A key 303 which positions the die D in the die holder DH is secured by a plurality of bolts 305. One part of the key 303 is provided in free engagement in the keyway 301.

With this configuration, by engaging the key 303 in the keyway 301, the die holder DH supporting the die D can easily be positioned in the lower turret 51. Accordingly, the precision between the die D and the lower turret 51 is not dependent on the precision of the die holder DH. It is therefore possible to reduce the number of parts.

Figure 17:
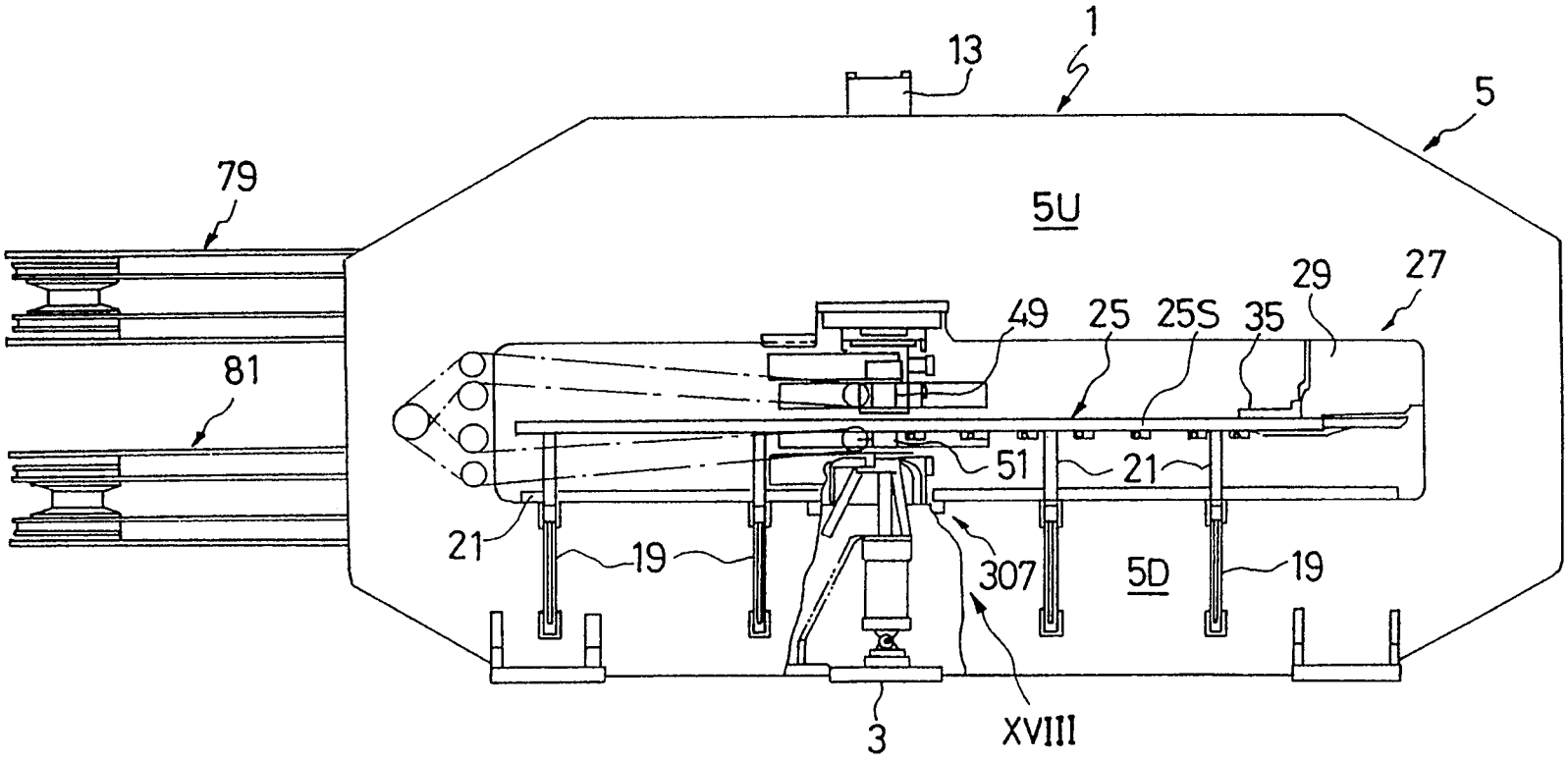
FIG. 17 is a view in the direction of the arrow XVII in FIG. 3.

As shown in FIG. 17, a die push-up device 307 is provided on the lower frame 5D of the main frame 5, raised to and maintained at the specified height of the die holder DH which supports the die D when the lower turret 51 is positioned in the work position.

Figure 18:
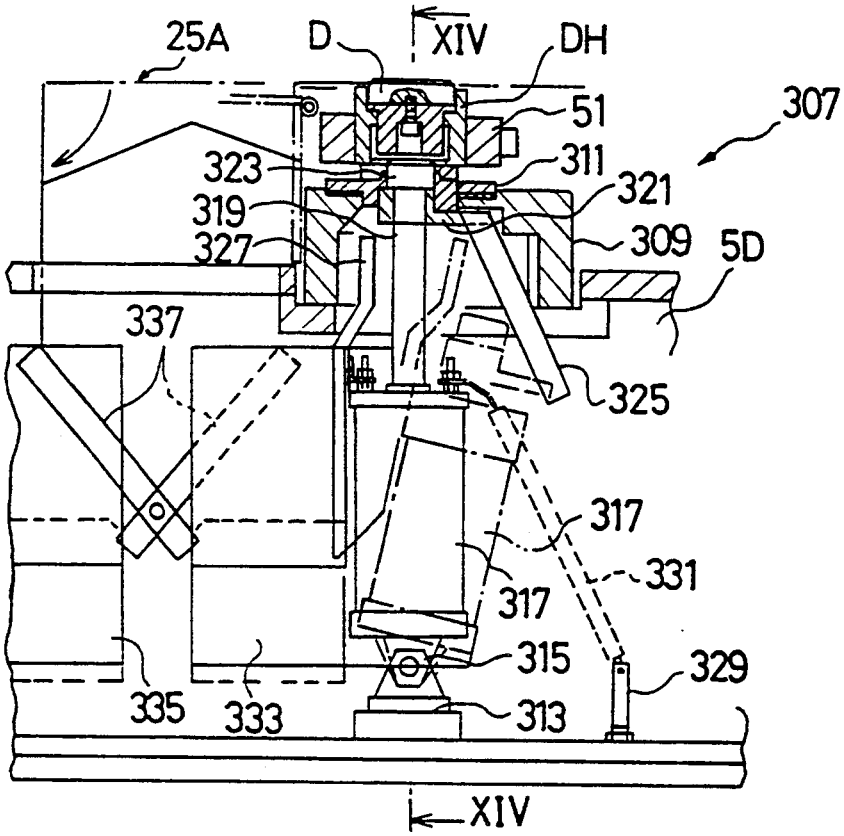
FIG. 18 is an enlarged view taken in the direction of the arrow XVIII in FIG. 17.
Figure 19:
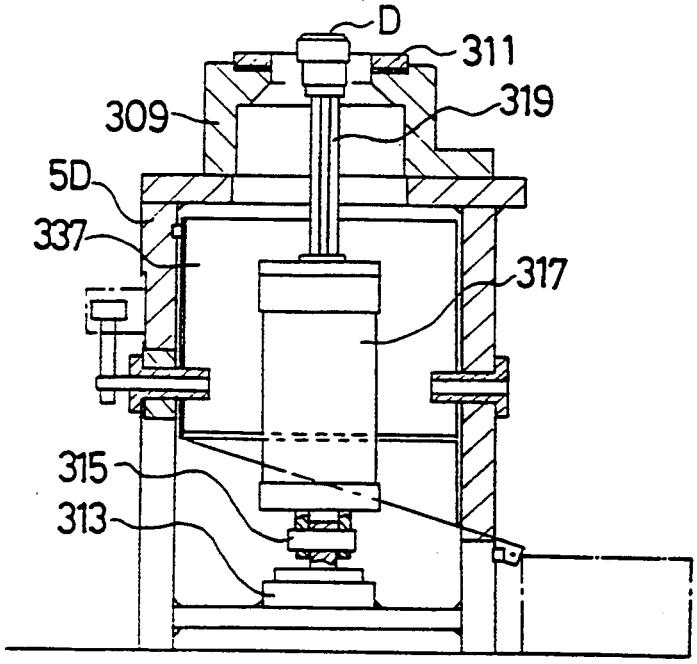
FIG. 19 is a sectional view taken along the line XIV—XIV in FIG. 18.

More specifically, as shown in FIG. 18 and FIG. 19, a support pedestal 309 is installed on the lower frame 5D. A ring-shaped support plate 311 is provided on the upper surface of the support pedestal 309. The lower turret 51 on which is mounted the die holder DH which supports the die D in a freely detachable manner is provided at the upper position of the support plate 311.

A bracket 313 is mounted on the lower frame 5D at the lower position of the support pedestal 309. The lower pare of a hydraulic cylinder 317 is supported in a freely swingable manner on the bracket 313 by a pin 315. A transfer member 321 is mounted on the upper part of a piston rod 319 installed in the hydraulic cylinder 317, and a die push-up support tool 323 is mounted on the end of the piston rod 319.

A guide member 325 is provided in the support pedestal 309. A work chute 327 is mounted on the cylinder 317 on the left side surface in FIG. 18. Also, a spring 331 is provided between the right end of the upper part of the hydraulic cylinder 317 and a mounting tool 329 installed on the lower frame 5D.

With this configuration, the hydraulic cylinder 317 with the piston rod 319 in the retracted state is normally in an inclined state, as shown by the one-point chain line in FIG. 18, from the energization force of the spring 331, and the die push-up support tool 323 is positioned away from the position where the die D is supported in the raised state.

Then, when hydraulic fluid is supplied to the cylinder 317 and the piston rod is gradually projected, the transfer member 321 is elevated along a guide member 325 so that the cylinder gradually reaches the perpendicular. The die D is the maintained in the elevated state by the die push-up support tool 323 mounted at the end of the piston rod 319.

When the hydraulic fluid is discharged from the cylinder 317, the hydraulic cylinder 317 reverts to its original inclined state from the energization force of the spring 331. When the hydraulic cylinder is again inclined, the work chute 327 is positioned at a point below the work position, and the scrap which drops from the punching process is guided to a scrap outlet 333 provided to the left of the hydraulic cylinder, as shown in FIG. 18.

A finished product outlet 335 is provided to the left of the scrap outlet 333 and a freely switchable work separator 337 is provided between the scrap outlet 333 and the finished product outlet 335.

With this configuration, a finished product of comparatively large size dropped from the chute 25A of the work table 25 can be discharged through the finished product outlet 335 by switching the work separator 337 to the right side in FIG. 18.

In this manner, because the position of the die push-up support device 307 can be freely switched between a position in which the die is supported in an elevated state and a position in which the die is not supported in the elevated state, it is possible to elevate the die D during a forming process, and easily disengage and set the die D at a non-obstructing position during a punching process. Accordingly, it is possible to use the turret punch press for a forming process and a punching process jointly. The present embodiment was explained using the example in which the hydraulic cylinder 317 is switched from the inclined state to the perpendicular state, but it is also possible for the hydraulic cylinder to be constructed so that it can be moved in the horizontal direction.

Furthermore, the present invention is not limited to the embodiments described above. Any suitable changes may be applied within the scope of the claims. The present embodiment was explained for a configuration in which the upper and lower turrets 49, 51 are shaped as rectangular parallelepipeds, but the invention can be applied equally as well to a conventional cylindrical turret.

As can be readily understood from the foregoing description of an embodiment of the present invention, during a punching operation, the punch and die holders in which the punch and die for the next operation are supported can be changed at high speed in a short time, and preparation time can also be reduced. In addition, the punch and die holders mounted on the upper and lower turrets, and the punch and die holders mounted in the punch and die holder magazines, can be directly exchanged through a linear operation. Therefore, the tool changing device can be fabricated with a simple and high speed mechanism. In addition, by providing upper and lower turrets with a rectangular parallelepiped shape, the turrets can be designed with a light weight at low cost.

We claim:

1. A turret punch press comprising:

a rotatable upper turret for detachable supporting a punch;

a rotatable lower turret for detachably supporting a die which processes a plate workpiece in collaboration with the punch;

a striker with vertical movement for striking a punch which has been indexed in a work position;

a plate positioning device for moving and positioning, in the X, Y directions, the plate workpiece, supported on a work table; and a tool changing device for detaching and changing the punch and die on the upper and lower turrets, respectively; characterized by a punch holder magazine, adjacent to the upper turret, for supporting a punch which is to be detached and changed at the upper turret;

a die holder magazine, adjacent to the lower turret, for supporting a die which is to be detached and changed at the lower turret;

wherein:

a punch changing position on the upper turret is below the punch holder magazine, a die changing position on the lower turret is above the die holder magazine, and the tool changing device is positioned on a vertical line between the punch and die changing positions so that the punches and dies can be changed by a direct linear operation, and a semicircular auxiliary table with a support member for supporting a plate workpiece is provided on the side of the lower turret.

2. A turret punch press comprising:

a rotatable upper turret for detachable supporting a punch;

a rotatable lower turret for detachably supporting a die which processes a plate workpiece in collaboration with the punch;

a striker with vertical movement for striking a punch which has been indexed in a work position;

a plate positioning device for moving and positioning, in the X, Y directions, the plate workpiece, supported on a work table;

a tool changing device for detaching and changing the punch and die on the upper and lower turrets, respectively; characterized by a sub-frame adjacent to a main frame of the punch press on which the striker is mounted, and a plurality of detachable tool holders for supporting, in a punch holder magazine and a die holder magazine supported on the sub-frame, a punch and a die respectively, which are to be detached and changed wherein:

the tool changing device is provided on the sub-frame, and a semicircular auxiliary table with a support member for supporting a plate workpiece is provided on the side of the lower turret.

3. A turret punch press as claimed in claim 1, wherein the punch and die holder magazines are provided on an endless chain which can move in the horizontal direction.

4. A turret punch press as claimed in claim 1, wherein the upper turret which supports the punch, and the lower turret which supports the die are shaped as rectangular members.

5. A turret punch press comprising:

a rotatable upper turret for detachable supporting a punch;

a rotatable lower turret for detachably supporting a die which processes a plate workpiece in collaboration with the punch;

a striker with vertical movement for striking a punch which has been indexed in a work position;

a plate positioning device for moving and positioning, in the X, Y directions, the plate workpiece, supported on a work table; and a tool changing device for detaching and changing the punch and die on the upper and lower turrets, respectively; characterized by a punch holder magazine, adjacent to the upper turret, for supporting a punch which is to be detached and changed at the upper turret;

a die holder magazine, adjacent to the lower turret, for supporting a die which is to be detached and changed at the lower turret;

wherein:

a punch changing position on the upper turret is below the punch holder magazine, a die changing position on the lower turret is above the die holder magazine, and the tool changing device is positioned on a vertical line between the punch and die changing positions so that the punches and dies can be changed by a direct linear operation; and a plurality of pinions is provided on a rotatable shaft on the upper and lower turrets and each pinion is engaged by a separate reciprocating rack.

6. A turret punch press comprising:

a rotatable upper turret for detachable supporting a punch;

a rotatable lower turret for detachably supporting a die which processes a plate workpiece in collaboration with the punch;

a striker with vertical movement for striking a punch which has been indexed in a work position;

a plate positioning device for moving and positioning, in the X, Y directions, the plate workpiece, supported on a work table; and a tool changing device for detaching and changing the punch and die on the upper and lower turrets, respectively; characterized by a punch holder magazine, adjacent to the upper turret, for supporting a punch which is to be detached and changed at the upper turret;

a die holder magazine, adjacent to the lower turret, for supporting a die which is to be detached and changed at the lower turret;

wherein:

a punch changing position on the upper turret is below the punch holder magazine, a die changing position on the lower turret is above the die holder magazine, and the tool changing device is positioned on a vertical line between the punch and die changing positions so that the punches and dies can be changed by a direct linear operation;

chuck hooks are provided in said tool changing device; and a pair of clamp hooks to clamp tools, are provided oppositely in said punch and die holder magazines, wherein the chuck hooks can clamp the tool from the direction at a right angle to the clamping direction of the clamp hooks, and the chuck hooks can pass between the clamp hooks.

7. A turret punch press of claim 1, further comprising:

chuck hooks provided in said tool changing device; and a pair of clamp hooks to clamp tools, provided oppositely in said punch and die holder magazines, wherein, the chuck hooks can clamp the tool from the direction at right angle to the clamping direction of the clamp hooks, and the chuck hooks can pass between the clamp hooks.

8. A turret punch press as claimed in claim 6, wherein the chuck hooks are provided on a piston rod mounted in a reciprocating manner on a hydraulic cylinder body or on the cylinder body itself, and a minicylinder which opens and closes the chuck hooks is provided on the piston or on the cylinder body.

9. A turret punch press as claimed in claim 6, comprising:

a suitable number of opening and closing chuck hooks provided on a chuck body capable of reciprocating motion along a guide member, and a reciprocating pull rod which opens and closes the chuck hooks;

a cam for causing the reciprocating motion of the chuck body, and a cam follower for engaging the cam, provided on the chuck body; and a second cam for activating the pull rod in the vicinity of the stroke end of the chuck body, provided on the pull rod or on the cam, and a cam follower for engaging the second cam, provided on the cam or on the pull rod.

10. A turret punch press as claimed in claim 9, wherein the pull rod and the chuck hooks are linked through a self-supporting link mechanism.

11. A turret punch press as claimed in claim 2, wherein the punch and die holder magazines are provided on an endless chain which can move in the horizontal direction.

12. A turret punch press as claimed in claim 2, wherein the upper turret which supports the punch, and the lower turret which supports the die are shaped as rectangular members.

13. A turret punch press of claim 2, further comprising:

chuck hooks provided in said tool changing device; and a pair of clamp hooks to clamp tools, provided oppositely in said punch and die holder magazines, wherein, the chuck hooks can clamp the tool from the direction at right angle to the clamping direction of the clamp hooks, and the chuck hooks can pass between the clamp hooks.

14. A turret punch press comprising:

a rotatable upper turret for detachable supporting a punch;

a rotatable lower turret for detachably supporting a die which processes a plate workpiece in collaboration with the punch;

a striker with vertical movement for striking a punch which has been indexed in a work position;

a plate positioning device for moving and positioning, in the X, Y directions, the plate workpiece, supported on a work table;

a tool changing device for detaching and changing the punch and die on the upper and lower turrets, respectively; characterized by a sub-frame adjacent to a main frame of the punch press on which the striker is mounted, and a plurality of detachable tool holders for supporting, in a punch holder magazine and a die holder magazine supported on the sub-frame, a punch and a die respectively, which are to be detached and changed wherein:

the tool changing device is provided on the sub-frame, and a plurality of pinions is provided on a rotatable shaft on the upper and lower turrets and each pinion is engaged by a separate reciprocating rack.

15. A turret punch press comprising:

a rotatable upper turret for detachable supporting a punch;

a rotatable lower turret for detachably supporting a die which processes a plate workpiece in collaboration with the punch;

a striker with vertical movement for striking a punch which has been indexed in a work position;

a plate positioning device for moving and positioning, in the X, Y directions, the plate workpiece, supported on a work table;

a tool changing device for detaching and changing the punch and die on the upper and lower turrets, respectively; characterized by a sub-frame adjacent to a main frame of the punch press on which the striker is mounted, and a plurality of detachable tool holders for supporting, in a punch holder magazine and a die holder magazine supported on the sub-frame, a punch and a die respectively, which are to be detached and changed wherein:

the tool changing device is provided on the sub-frame, and chuck hooks are provided in said tool changing device; and a pair of clamp hooks to clamp tools, are provided oppositely in said punch and die holder magazines, wherein the chuck hooks can clamp the tool from the direction at a right angle to the clamping direction of the clamp hooks, and the chuck hooks can pass between the clamp hooks.

16. A turret punch press as claimed in claim 7, wherein a plurality of pinions is provided on a rotatable shaft on the upper and lower turret, and each pinion is engaged by a separate reciprocating rack.

17. A turret punch press as claimed in claim 8, wherein a plurality of pinions is provided on a rotatable shaft on the upper and lower turret, and each pinion is engaged by a separate reciprocating rack.

18. A turret punch press as claimed in claim 9, wherein a plurality of pinions is provided on a rotatable shaft on the upper and lower turret, and each pinion is engaged by a separate reciprocating rack.

19. A turret punch press as claimed in claim 13, wherein a plurality of pinions is provided on a rotatable shaft on the upper and lower turret, and each pinion is engaged by a separate reciprocating rack.

20. A turret punch press as claimed in claim 15, wherein the chuck hooks are provided on a piston rod mounted in a reciprocating manner on a hydraulic cylinder body or on the cylinder body itself, and a minicylinder which opens and closes the chuck hooks is provided on the piston or on the cylinder body.

21. A turret punch press as claimed in claim 15, comprising:

a suitable number of opening and closing chuck hooks provided on a chuck body capable of reciprocating motion along a guide member, and a reciprocating pull rod which opens and closes the chuck hooks;

a cam for causing the reciprocating motion of the chuck body, and a cam follower for engaging the cam, provided on the chuck body; and a second cam for activating the pull rod in the vicinity of the stroke end of the chuck body, provided on the pull rod or on the cam, and a cam follower for engaging the second cam, provided on the cam or on the pull rod.

22. A turret punch press as claimed in claim 20, wherein a plurality of pinions is provided on a rotatable shaft on the upper and lower turret, and each pinion is engaged by a separate reciprocating rack.

23. A turret punch press as claimed in claim 21, wherein a plurality of pinions is provided on a rotatable shaft on the upper and lower turret, and each pinion is engaged by a separate reciprocating rack.

24. A turret punch press as claimed in claim 21, wherein the pull rod and the chuck hooks are linked through the self-supporting link mechanism.

* * * * *

UNITED STATES PATENT AND TRADEMARK OFFICE

CERTIFICATE OF CORRECTION

PATENT NO. : 5,350,347
DATED : September 27, 1994
INVENTOR(S) : Takayuki FUJIWARA et al.

It is certified that error appears in the above-indentified patent and that said Letters Patent is hereby corrected as shown below:

At column 5, line 61, change ".-95" to ---95---.

At column 8, line 16, change "45" to ---145---.

At column 8, line 23, change "51" to ---151---.

At column 8, line 28, change "61" to ---161---.

At column 9, line 37, change "extended-vertically" to ---extended vertically---.

At column 11, line 23, change "45" to ---245---.

At column 12, line 36, change "pare" to ---part---.

At column 13, line 53 (claim 1, line 2), change "detachable" to ---detachably---.

At column 14, line 16 (claim 2, line 2), change "detachable" to ---detachably---.

At column 14, line 50 (claim 5, line 2), change "detachable" to ---detachably---.

At column 15, line 13 (claim 6, line 2), change "detachable" to ---detachably---.

At column 16, line 34 (claim 14, line 2), change "detachable" to ---detachably---.

Signed and Sealed this

Thirtieth Day of May, 1995

*Attest:*

*Attesting Officer*

Bruce Lehman

BRUCE LEHMAN

*Commissioner of Patents and Trademarks*